United States Patent [19]

O'Brien

[11] Patent Number: 4,890,693

[45] Date of Patent: Jan. 2, 1990

[54] KNOCK-DOWN SUPPORT STAND AND KIT FOR ASSEMBLY THEREOF

[76] Inventor: Charles E. O'Brien, 26 Guild Rd., Saugus, Mass. 01986

[21] Appl. No.: 306,093

[22] Filed: Feb. 6, 1989

[51] Int. Cl.[4] ..... B27B 21/00; B25H 1/06

[52] U.S. Cl. ..... 182/151; 182/181; 182/224

[58] Field of Search ..... 182/151, 181–186, 182/224, 225, 226, 178

[56] References Cited

U.S. PATENT DOCUMENTS

| | | | |
|---|---|---|---|
| 467,081 | 1/1892 | Church | 182/151 |
| 3,035,660 | 5/1962 | Leon | 182/181 |
| 3,089,682 | 5/1963 | Parker | 182/181 |
| 3,300,245 | 1/1967 | Rumble | 182/151 |
| 3,721,316 | 3/1973 | Greenplate | 182/181 |
| 3,760,903 | 9/1973 | Thompson | 182/181 |
| 4,105,091 | 8/1978 | Mahan | 182/151 |
| 4,182,432 | 1/1980 | Cossitt | 182/151 |
| 4,390,081 | 6/1983 | Olmsted | 182/151 |
| 4,433,753 | 2/1984 | Watson | 182/181 |
| 4,570,915 | 2/1986 | O'Hern | 182/151 |

*Primary Examiner*—Reinaldo P. Machado
*Attorney, Agent, or Firm*—Herbert L. Gatewood

[57] ABSTRACT

A knock-down support stand or trestle for use as a sawhorse on construction sites and for home use constructed of pre-cut or pre-formed components that are readily assembled together in interlocking engagement without need for use of fasteners of any kind. As the load on the support stand increases, the components of the support stand become more securely interlocked together.

10 Claims, 2 Drawing Sheets

KNOCK-DOWN SUPPORT STAND AND KIT FOR ASSEMBLY THEREOF

BACKGROUND OF THE INVENTION (a) Field Of The Invention

This invention relates, in general, to a support stand or trestle suitable for use as a sawhorse and to its method of manufacture from pre-cut components. In particular, this invention relates to a knock-down support stand and to a kit comprising pre-cut or pre-formed components designed to fit together in a logical sequence in interlocking engagement for providing the support stand whenever and wherever needed for use.

(b) Description Of The Prior Art

Heretofore others have disclosed sawhorses provided from pre-cut components and kits for their assembly. Exemplary of this prior art are U.S. Pat. Nos. 3,760,903; 4,182,432; and 4,390,081. In U.S. Pat. No. 3,760,903, there is disclosed a sawhorse which comprises an elongated top support member defining four beveled surfaces, four leg members and two gussets or brace members. The gussets are of trapezoidal shape and are each provided with grooves on their inside surface along their non-parallel edges for receipt of a portion of the top edge of a leg member. The gussets are connected to the leg members by fastening means, e.g. nails, which intrude through the gusset into the leg member, along the edge. The leg members are also connected to the top support member by fastening means which intrude from the outside surface of and through the leg members into the support member at the beveled surfaces. Due to the construction of the sawhorse, however, it would appear that the greater the load placed thereon, the greater there is the tendency for the legs to spread apart from one another not only in the lateral direction but also in the longitudinal direction. As the load increases, the legs will have a tendency in the longitudinal direction to pivot with respect to one another in counter rotating directions. Accordingly, the legs and gussets in combination with one another will have the tendency to separate from the respective beveled surfaces. And, as the load increases, the legs laterally opposed to one another will have the tendency to separate from one another laterally in a larger diverging angle resulting in the leg members being separated from the gusset to which they are attached and from the beveled surfaces of the elongated support member.

U.S. Pat. No. 4,182,432 discloses a knock-down support apparatus which does not require any fasteners. This apparatus comprises a T-section cross-beam and two interlocking legs for connection thereto. The legs are provided with T-shaped cuts extending downwardly from the middle thereof and partially across the top. And the T-section cross-beam is provided with upwardly extending slots in the vertical section thereof for receipt of the legs. Although this apparatus may be quite suitable for some purposes, and would appear to have the advantage of ease of assembly and without need for use of fastening means, its use is believed to be somewhat limited due to its construction. In particular, the legs do not appear to be supported sufficiently along their inside and outside surfaces to enable the support apparatus to support very heavy loads. Only the interlock between the T-section cross-beam and the legs at the horizontally disposed platform would seem to prevent the legs from spreading apart in a longitudinal direction when a load is placed on the platform member. Moreover, the shape: of the T-section cross-beam requires added storage space for the support apparatus.

The sawhorse disclosed in U.S. Pat. No. 4,390,081 is somewhat similar to that disclosed in U.S. Pat. No. 3,760,903, in that it comprises four leg members, an elongated top support surface defining four beveled surfaces, two gussets or brace members, and fastening means for fastening the leg members to the beveled surfaces and the brace members to the leg members. The sawhorses differ, however, in that the beveled surfaces in U.S. Pat. No. 4,390,081 are defined by notches provided inwardly a predetermined distance from each end of the elongated top support surface rather than just inwardly from the ends as in U.S. Pat. No. 3,760,903. Thus, the leg members are confined at both sides at the top thereof and the leg members are deemed less likely to pivot in the longitudinal direction in counter-rotating directions as load on the sawhorse increases. Nevertheless, it would appear that, like the sawhorse in U.S. Pat. No. 3,760,903, there still remains the problem of lateral separation of leg members as the load is increased attendant with separation of the leg members from the brace members and from the beveled surfaces. Moreover, this sawhorse still requires separate fastening means in the assembly and connection together of the pre-cut components, in addition to a hammer or other tool for driving the fastening means into the pre-cut wood components.

SUMMARY OF THE INVENTION

The present invention has as a major object the provision of a novel support stand or trestle suitable for use as a sawhorse for cutting lumber or for supporting other articles, and one not believed attendant with those problems of prior art such devices as disclosed above.

A further object of the invention is to provide a knock-down sawhorse for use at construction sites where a large number of such devices are needed but time is not readily available for constructing sawhorses from scratch.

A still further object of the invention is to provide a relatively inexpensive sawhorse suitable for use on construction sites.

An even further object of the invention is to provide a support stand or trestle of relatively simple design and low cost making such suitable for home use particularly where limited skill prevents a person from constructing such a structural apparatus.

A still further object of the invention is to provide a support stand capable of supporting greater loads than such support stands known heretofore having a top support member of somewhat larger dimensioned wood.

Quite advantageously, the support stand provided by this invention can be readily and easily assembled together without need for fastening means of any type, and without need for any tools.

Another advantage is that the support stand of the invention can be provided from pre-cut components of readily available lumber of standard stock.

A further advantage of this invention is that the support stand, when disassembled, can be readily stored in stacked formation in a minimum of space.

A still further advantage of the invention is that it can be provided in kit form comprising pre-cut components that are designed to fit together in interlocking engagement in logical sequence, making for ease in providing the support stand.

Still another advantage of the invention is that as the load thereon increases the interlocking components thereof become even more securely interlocked together.

Yet another advantage of the invention is that it can be readily disassembled and stored away or transported to another place for use, as desired.

An even further advantage of the invention is that the precut members comprising the support stand of the invention can be stacked together and maintained in such stack by relatively inexpensive packaging means.

The above objects and advantages, and others, as will be apparent from a reading of this disclosure are attained, in general, by a support stand comprising (a). an elongated, horizontally disposed, top support member having a trapezoidal-shaped cross section and being defined by horizontally disposed, planar, top and bottom surfaces parallel to one another, non-parallel side surfaces which taper inwardly and upwardly from said bottom surface at equal angles defining inclined surfaces and terminating at the said top surface, and end edges defining the length of the elongated member;

(b). an elongated cross-bar having a rectangular-shaped cross section and defined by horizontally disposed, planar, top and bottom surfaces parallel to one another, vertically disposed, planar, sides parallel to one another and of somewhat greater width than the width of the said top and bottom surfaces, and vertically disposed, parallel, planar ends, said cross-bar being so located as to be disposed in contiguous engagement with the said bottom surface of the elongated top support member midway between the side surfaces thereof along its lengthwise direction;

(c). first and second brace members each having a trapezoidal shape spaced apart from one another and being located adjacent the ends of said cross-bar and in interlocking engagement therewith for supporting said elongated top support member, and (d). four elongated, rectangular-shaped leg members each of which is defined by inner and outer, parallel, planar surfaces, parallel, planar side surfaces intersecting therewith, and top and bottom, planar edges parallel to one another and lying in planes inclined at an angle less than 90 degrees with respect to the planes defined by the planar inner and outer surfaces of the leg member whereby on being in assembled disposition the top edges of the leg members in opposition to one another will lie in a plane which includes that of the top surface of said elongated support member and the planar bottom edges of the leg members will all lie in the same plane, said leg members being disposed in pair in opposition to one another adjacent to and inwardly from the respective ends of the cross-bar and being in interlocking engagement with respective brace members.

DETAILED DESCRIPTION OF THE INVENTION AND THE PREFERRED EMBODIMENTS THEREOF

Figure 1:
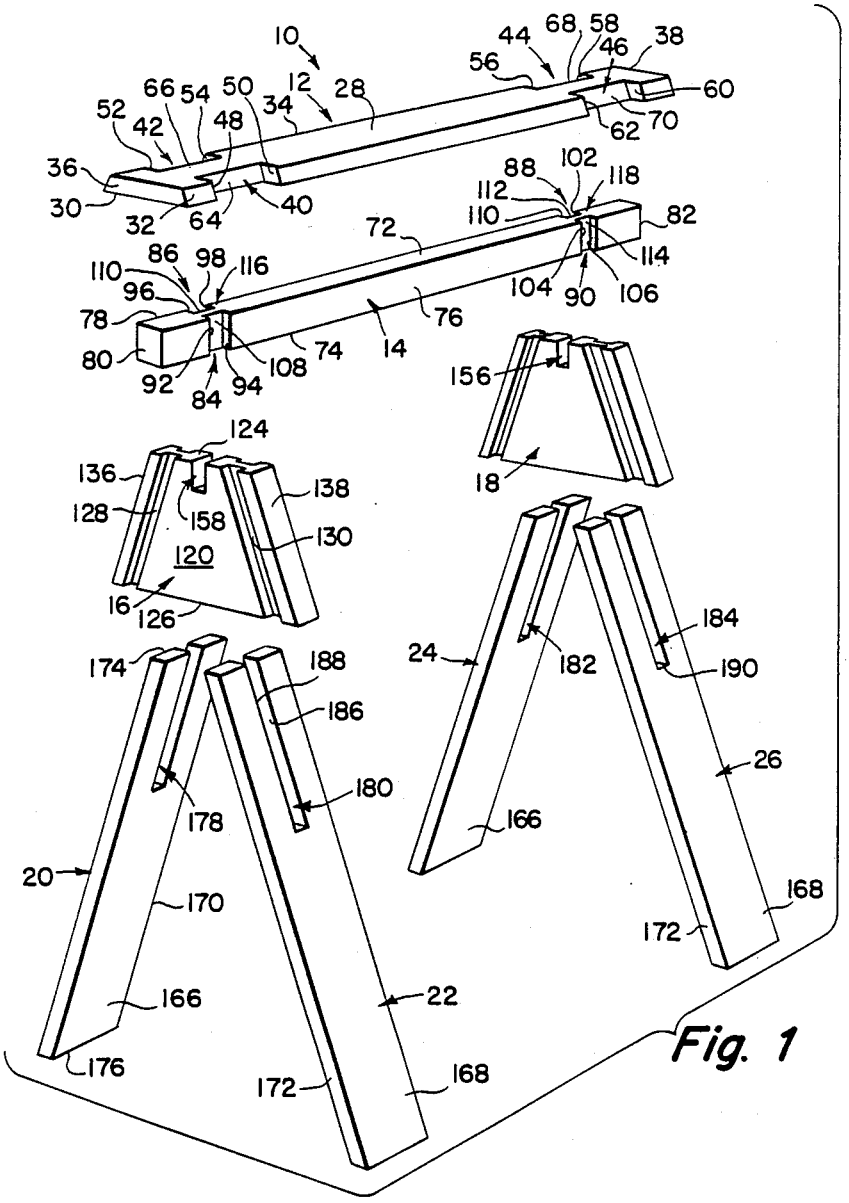
FIG. 1 is an exploded view in perspective of a support stand or trestle in accordance with the invention showing each of the pre-cut components comprising such support stand.

Referring now to the drawing, there is shown in FIG. 1 thereof a support stand or trestle 10 according to the invention comprising an elongated support member 12, an elongated cross-bar 14, two brace members or gussets 16, 18 and four leg members 20,22,24, and 26.

The elongated support member 12, as shown in FIG. 1, has a trapezoidal-shaped cross-section and is defined by horizontally disposed, planar, top and bottom surfaces 28, 30 parallel to one another, non-parallel, vertically disposed, planar, side surfaces or edges 32, 34 which slope upwardly from bottom surface 30 and inwardly with respect to one another at predetermined angles, and parallel, vertically disposed, end edges or surfaces 36, 38. The side surfaces 32, 34 define inclined surfaces which are defined by vertically disposed planes that slope inwardly and intersect with an imaginary plane extending vertically upwardly from and dividing the elongated support member 12 longitudinally into two halves between the side surfaces 32, 34. Located inwardly from the end surfaces 36, 38 equal predetermined distances are four notches 40, 42, and 44,46, respectively, defined by vertically disposed, spaced-apart shoulders 48 and 50, 52 and 54, 56 and 58, and 60 and 62, respectively, and which, in turn, define beveled or inclined planar surfaces 64 and 66, 68 and 70. The beveled surfaces 64, 66 are in direct opposition to one another longitudinally along the length of the elongated top support member 12, as are beveled surfaces 68, 70. The beveled or inclined surfaces 64, 70 and 66, 68 which are on the same but opposite sides of the support member 12 are in planes parallel to those defined by the side surfaces 32, 34. The end surfaces 36, 38 though disclosed in the drawings to be vertically disposed and perpendicular to bottom surface 30 can, if desired, be tapered inwardly and upwardly, at some suitable angle.

Cross-bar 14, as will be appreciated by reference to FIG. 1, is of rectangular cross-section and is defined by horizontally-disposed top and bottom, parallel, planar surfaces 72, 74, vertically disposed, planar, parallel sides 76, 78, and vertically disposed, planar, parallel ends 80, 82. Inwardly from each end 80, 82 and equidistantly therefrom, respectively, are provided vertically disposed rectangular-shaped grooves or channels 84, 86 and 88, 90, in opposition to one another in pairs, longitudinally, as shown, the purpose for which will be later made clear. Grooves 84, 86, 88, and 90 are defined by vertically disposed spaced-apart, parallel shoulders 92 and 94, 96 and 98, 100 and 102, 104 and 106, respectively, which, in turn, define vertically disposed, planar surfaces 108 and 110, 112 and 114. The surfaces 108 and 110, 112 and 114 are parallel to one another, respectively, and define vertically disposed webs 116,118.

Figure 2:
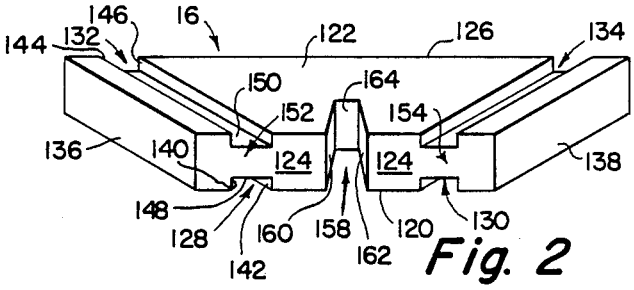
FIG. 2 is an end view of one of the novel trapezoidal-shaped gussets or brace members of the support stand for supporting the elongated support member thereof and for interlocking with the cross-bar and the leg members, taken looking at the gusset in the direction of the top edge thereof.

The gussets or brace members 16, 18 have a rectangular-shaped cross-section as more clearly shown in FIG. 2 and are of identical trapezoidal-shape; accordingly, only one will be particularly described hereinafter. Gusset 16 is defined by planar, vertically disposed, front and back surfaces 120, 122 in parallel disposition to one another, a top, horizontally disposed, planar edge 124 parallel to a bottom, horizontally disposed, planar edge 126 of somewhat greater, predetermined length. Turning now to FIGS. 1 and 2, it will be seen that gusset 16 is provided with rabbets or grooves 128, 130 and 132, 134 in the front and back surfaces 120, 122, respectively, along the non-parallel, planar side edges 136, 138 thereof. These grooves are in pairs and in direct opposition to one another, as seen in FIG. 2, the purpose for which will soon be explained. The grooves 128, 132, are defined by spaced-apart, parallel shoulders 140, 142, and 144, 146, respectively, which extend inwardly from the side edge 136 and are perpendicular to respective front and back surfaces 120, 122. These shoulders terminate in and define planar surfaces 148, 150 which, in turn, define the bottom of grooves 128, 132. The bottom surfaces 148, 150 are parallel to one another and to the top and bottom surfaces 120, 122 and define a web 152 between the bottom surfaces of the grooves 128, 132. As will be appreciated by reference to FIG. 1, the grooves 128, 132 are of rectangular shape, the opposed shoulders 140 and 142 and 144 and 146 being parallel to one another and to side edge 136, and are spaced-apart from one another a predetermined distance. Grooves 130, 134 are of like dimensions as grooves 128, 132 and are likewise of rectangular-shaped cross-section and are defined by spaced apart shoulders parallel to one another and to non-parallel side edge 138. These grooves define web 154 which like web 152 extends from the top edge 124 to the bottom edge 126. Also, as seen in FIG. 1, gusset 16 is provided with a vertically disposed rectangular-shaped notch 158 (a similar notch 156 is provided in gusset 18) extending inwardly a predetermined distance from the top edge 124 which, as will be appreciated, is to accommodate one of the webs 116, 118 provided in the cross-bar 14. Notch 158 is defined by vertically disposed sides 160, 162 which extends vertically downwardly from top edge 124 and perpendicular thereto, and terminates in horizontally disposed bottom surface 164. This bottom surface, as will be appreciated, is parallel to the top and bottom surfaces 124, 126. The depth of notch 158 must be such as to accommodate web 116 in cross-bar 14 when the support stand 10 is assembled and to provide such in abutting engagement with the bottom surface 30 of the elongated support member 12 along its entire length.

Figure 4:
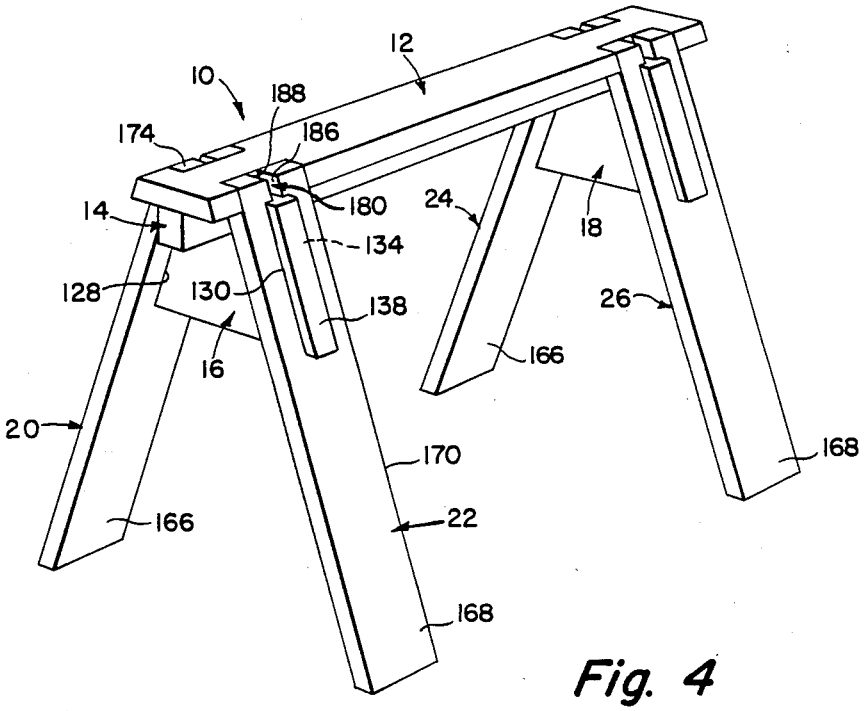
FIG. 4 is a view in perspective of the assembled support stand of the invention shown in FIGS. 1 and 3.

The leg members 20, 22, 24, and 26 are each of rectangular cross-section and are each defined by relatively broad width inner and outer planar, parallel surfaces 166, 168, relatively narrow width elongated parallel side edges 170, 172 and top and bottom edges 174, 176. The top and bottom edges 174, 176 on each leg member are inclined in such a manner that when the support stand is in its assembled disposition, the top edges in opposition to one another will be provided in a plane which includes that of the horizontally disposed top surface 28 of the elongated support member 12, and the bottom edges will all be in a plane parallel to the top surface 28 so that when the support stand 10 is supported by a support surface such as a floor or the level ground, the bottom edges of the leg members will all be in supporting contact with the support surface. The leg members 20, 22, 24, and 26 are provided, respectively, with longitudinally extending slots 178, 180, 182, 184 which extend vertically downwardly from the top edges of the respective leg members the same predetermined distance. These slots are of rectangular-shape and are each located midway between the side edges 170, 172, of the respective leg members and are each defined by vertically disposed, parallel, planar sides 186, 188 which terminate in bottom end surface 190 extending from the inner surface to the outer surface in each leg member and which are in a plane parallel to that defined by the top support member. The sides 186, 188 are spaced apart sufficiently and the slots 178, 180, 182, and 184 are of such longitudinal final length as to accommodate the webs 152, 154 when the support stand is in assembled disposition, as is shown in FIG. 4. Critically, the slots in the leg members should be of such length as to maintain the top surface 72 of cross-bar 14 and the top edge 124 of the brace members in contiguous relationship to the bottom surface 30 of the elongated support member.

Figure 3:
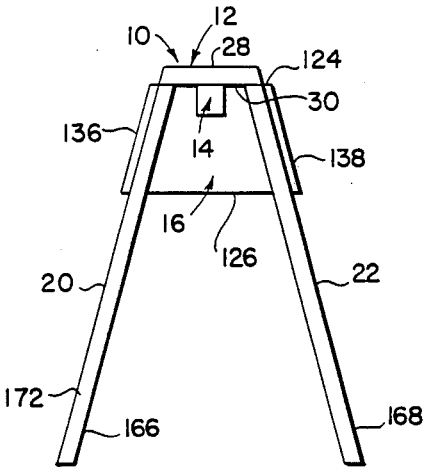
FIG. 3 is an end view of a support stand according to the invention and as shown in FIG. 1 but showing the pre-cut components comprising the support stand in assembled disposition with respect to one another.

In use of the support stand 10 of the invention, one leg member, e.g. leg member 20, of a first pair of laterally opposed leg members 20, 22 will be placed in an upright position. One of the gussets will then be associated with that leg member in such a manner as to cause the web connecting the opposed grooves e.g., grooves 128, 132 in the gusset 16 to intrude into the slot 178 in the leg member 20 and to be pushed downwardly therein until the bottom edge 126 of the gusset bottoms against the bottom end surface 190 of the slot. The top edge 124 of the gusset, as will be appreciated by reference to FIGS. 3 and 4, will then lie in the plane abutting bottom surface 30 of the elongated support member 12. Next, the other of the opposed leg members i.e., leg member 22, is associated with the gusset in the same manner. The other two opposing leg members 24, 26 are then associated with the other gusset 18 in the same way, after which the cross-bar 14 is assembled with the gussets 16, 18 so that the webs 116, 118 between the respective opposed grooves 84,86 and 88,90 provided therein are pushed into the vertically disposed slots or notches 156, 158, provided in the gussets or brace members. Thus, the partially assembled support stand 10 can then support itself in upright position for placement of the top support member 12 and interlocking thereof into the assembly.

The various components comprising the support stand 10, in accordance with the invention, can be readily provided and pre-cut from lumber of standard size. Although the components can be cut from lumber of any suitable dimensions, a support stand having suitable load bearing characteristics for most applications will be provided if the elongated top support member 12 is cut from 1"×6" lumber, e.g. common pine, and the leg members and cross-bar from 1"×4" lumber. The brace members can be cut from 1"×8" lumber. Although these sizes of lumber will be found suitable for most purposes, it will be appreciated that other sizes may be found more suitable in some cases. The critical concerns of this invention are the interlocking features not the particular lumber dimensions used. Nevertheless, use of the cross-bar 14 in contiguous relationship with the bottom surface 30 of the top support member 12, and in the particular orientation shown in the drawings, permits use of an elongated support member 12 of lesser thickness dimension than usual to support the same load. The cross-bar 14, with its wider faces being vertically disposed, provides greater resistance to bending than with such faces horizontally disposed. Thus, even though the support member 12 is of relatively thin lumber, the effect of the cross-bar in combination therewith gives the same, or similar, load characteristics as a support member of much thicker lumber, e.g. a 2"×6", or even a 3"×6". The angles made by the top and bottom edges of the leg members with respect to the parallel outer and inner surfaces of the leg members should preferably be such as to provide, when the support stand is assembled for use, a distance between outer surfaces of opposing leg members of no more than about 16 inches. This will provide a support member of reasonable height vertically for most purposes and result in a support stand with good stability and load bearing characteristics. Nevertheless, if such requirements are not of prime importance and consideration in use of the support member, the leg members can be of somewhat greater length whereby the distance between opposing leg members will increase accordingly. The greater the distance between opposing leg members, in general, the poorer will be the load bearing capabilities.

One can readily appreciate by reference to FIG. 4 that the leg members located on the same side of the elongated support member are stabilized in a longitudinal direction and are maintained in the same relative location with respect to one another during use not only by the location of the top portions of the leg members in the notches 40, 42, 44, and 46 provided in the top support member 12 but also by the interlocking of the cross-bar 14 with the notches 156, 158 provided in the gussets at each end thereof. The interlocking of the webs in the gussets with the slots in opposing leg members prevents the lateral separation of one leg from another. Thus, as the support stand of the invention is loaded, the opposing leg members will be caused to pivot outwardly with respect to one another; however, such motion will be prevented by the inside top surface of the leg member pressing against the respective beveled surfaces of the support member 12 and the outside surfaces of the leg members being in abutting engagement with the outside surfaces of the grooves in the gusset. The interlocking of the cross-bar 14 with the brace members 16, 18 also adds to the stability of the support stand as such helps prevent separation of the leg members from one another in the longitudinal direction.

Although in the most preferred aspect of the invention, the pre-cut members will be provided of wood of standard sizes, such is not critical to the basic concept. It will be appreciated that the various components comprising the invention can also be manufactured from metal, e.g. aluminum, or plastic, according to usual techniques. For example, the various components comprising the support stand can be molded from various known plastic compositions, e.g. polyvinyl chloride, or more suitable structural plastics such as the polyacetal resins. The plastic compositions used can, if desired, include conventional reinforcing materials, e.g. glass or other fibers, for structural strength purposes depending upon the intended use for the support stand. The support stand or trestle 10 of the invention can be readily provided in kit form to be assembled together whenever desired. In such form the invention will comprise an elongated support member 12, a cross-bar 14, two gussets 16, 18, and four leg members 20, 22, 24, and 26, each as above-described. These various components comprising the support stand can be stacked in a pile, one component on top of another, and can be held together in such a stack by appropriate conventional strapping members. Such strapping members can be of conventional webbing the ends of which can be provided with fastening means such as buckles or Velcro fastening strips. Two of such strapping members can be used, one at each end of the stack of components for better maintaining the stack of components together. The two strapping members can be connected together by a third strap-like member extending longitudinally of the stack providing a handle for carrying the support stand, if desired. Also, if desired, the kit components can be provided in suitable, re-usable packaging or container means for easier storage or carrying, e.g., envelope shaped packages of canvas or fishnet (plastic net) material.

Other modifications and changes, as will be understood by those skilled in the art, can be made in the invention disclosed herein and in its form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as properly come within the spirit and scope of the invention disclosed.

What is claimed is:

1. A knock-down support stand for use for supporting various articles in horizontal disposition comprising:

(a). an elongated, horizontally disposed, top support member having a trapezoidal shaped cross section and being defined by horizontally disposed, planar, top and bottom surfaces parallel to one another, non-parallel side surfaces which taper inwardly and upwardly from said bottom surface at equal angles defining inclined surfaces and terminating at the said top surface, and end edges;

(b). an elongated cross-bar having a rectangular-shaped cross section and defined by horizontally disposed, planar, top and bottom surfaces parallel to one another, vertically disposed, planar, sides parallel to one another and of somewhat greater width than the width of the said top and bottom surfaces, and vertically disposed, parallel, planar ends, said cross-bar being so located as to be disposed in contiguous engagement with the said bottom surface of the elongated top support member along its lengthwise direction;

(c). first and second brace members each having a trapezoidal shape spaced apart from one another and being located adjacent the ends of said cross-bar and in interlocking engagement therewith for supporting said elongated top support member; and (d). four elongated, rectangular-shaped leg members each of which is defined by inner and outer, parallel, planar surfaces, parallel, planar side surfaces intersecting therewith, and top and bottom, planar edges parallel to one another and lying in planes inclined at an angle less than 90 degrees with respect to the planes defined by the planar inner and outer surfaces of the leg member whereby on being in assembled disposition the top edges of the leg members in opposition to one another will lie in a plane which includes that of the top surface of said elongated support member and the planar bottom edges of the leg members will all lie in the same plane, said leg members being disposed in pairs in opposition to one another adjacent the respective ends of the cross-bar and being in interlocking engagement with respective brace members.

2. A knock-down support stand according to claim 1 wherein the said elongated top support member is further defined by two pairs of notches located in the said side surfaces in opposition to one another and inwardly from respective end surfaces equidistantly for location of the top edges of opposing leg members.

3. A knock-down support stand according to claim 2 wherein each of said brace members has a rectangular-shaped cross section and is defined by a planar, horizontally disposed top edge and a planar, horizontally disposed, parallel bottom edge of somewhat greater length, planar, parallel, vertically disposed front and back surfaces, and planar, vertically disposed side edges which incline inwardly at equal angles connecting said top and bottom edges, and a vertically disposed, rectangular-shaped notch is provided in said brace member extending downwardly from said top edge midway between the said side edges for location of and supporting in interlocking engagement of the cross-bar therein.

4. A knock-down support stand according to claim 3 wherein an elongated, rectangular-shaped slot is provided in each said leg member extending longitudinal downwardly from the top edge and being located midway between the parallel side edges, one of said brace members being located in the slots in opposing leg members in interlocking engagement therewith and being supported in vertical disposition by the said opposing leg members whereby the distance between the opposing leg members is maintained and said opposing leg members are prevented from separating apart from one another.

5. A knock-down support stand capable of being readily assembled/disassembled as desired comprising in combination:

(a). an elongated, horizontally disposed, top support member having a trapezoidal-shaped cross section and being defined by horizontally disposed, planar, top and bottom surfaces in parallel disposition one to the other, non-parallel side surfaces which taper inwardly and upwardly from said bottom surface at equal angles defining inclined surfaces and terminating at the said top surface, and first and second end edges defining the length of the said support member, opposed notches being provided in the respective side surfaces inwardly from said first and second end edges and equidistant therefrom, each said notch being defined by vertically disposed, spaced-apart shoulders extending inwardly from respective side surfaces and perpendicular thereto and terminating at and defining planar beveled surfaces in parallel disposition to respective non-parallel side surfaces;

(b). an elongated cross-bar having a rectangular-shaped cross section and being defined by horizontally disposed, planar, parallel top and bottom surfaces, vertically disposed, planar, parallel sides of somewhat greater width dimension than the width dimension of said top and bottom surfaces, and first and second ends determining the length of said cross-bar, the said elongated support member and the cross-bar being of the same length, vertically disposed grooves being provided in the said sides of the cross-bar in opposition to one another and inwardly from the said first and second ends thereof equidistantly, each said groove being of rectangular shape and being defined by vertically disposed, spaced apart, parallel shoulders extending inwardly from respective sides and terminating in vertically disposed, planar surfaces which surfaces in opposition to one another define vertically disposed webs;

(c). first and second brace members each having a trapezoidal shape and being defined by a rectangular-shaped cross section defined by a planar, horizontally disposed top edge and a planar, horizontally disposed bottom edge parallel thereto and of somewhat greater length than said top edge, planar, vertically disposed, parallel front and back surfaces, and planar, vertically disposed side edges which incline inwardly toward one another at equal angles and connect said top edge to said bottom edge, a notch being provided in each said brace member of rectangular shape and extending vertically downwardly from the said top edge a predetermined distance sufficient to accommodate the vertical dimension of the said cross-bar so that the plane defined by the said top edge includes that defined by the top surface of the cross-bar, said notch being defined by vertically disposed, planar, spaced-apart shoulders extending inwardly from the said top edge and terminating in a horizontally disposed, planar bottom surface parallel to the said top edge, a web of the cross-bar being located in a notch in each of the said braces in interlocking engagement and providing the top surface of the crossbar in abutting engagement with the bottom surface of the top supporting member, and along its entire length, said brace members each being further defined by rectangular-shaped grooves provided in the said front and back surfaces in opposition to one another inwardly from respective side edges the same distance and extending from the said top edge to the said bottom edge of each said brace member, each said groove being inwardly a predetermined distance from respective front and back surfaces and terminating in planar surfaces parallel to the front and back surfaces and defining webs extending from the top edge to the bottom edge of the brace member in parallel disposition to respective side edges; and (d). four elongated, rectangular-shaped leg members each of which is defined by inner and outer parallel, planar surfaces, parallel, planar side surfaces intersecting therewith, and top and bottom planar, parallel edges, the planes of said top and bottom edges being parallel to one another and intersecting with the planes defined by the inner and outer surfaces so as to provide a beveled surface, an elongated rectangular-shaped slot being provided in each said leg member and extending longitudinally inwardly from the top edge thereof the same predetermined distance, each said slot being located midway between the side edges and being defined by spaced-apart, parallel, vertically disposed planar sides which terminate in bottom end surfaces parallel to and lying in a plane parallel to that defined by the top edge of the leg member, the opposing webs in a brace member being located in the said elongated slots of opposing leg members whereby to provide the opposing leg members and brace member in interlocking engagement with one another.

6. A knock-down support assembly according to claim 5 wherein the various components are of wood and the elongated top support member is cut from a 1"×6", the brace members are cut from a 1"×8" piece of lumber, and the cross-bar and leg members are cut from 1"×4" lumber.

7. A kit for providing a readily assembled/disassembled knockdown support stand for use in supporting articles in a horizontally disposed fashion, said kit comprising:

(a). an elongated, horizontally disposed, top support member having a trapezoidal-shaped cross section and being defined by horizontally disposed, planar, top and bottom surfaces in parallel disposition one to the other, non-parallel side surfaces which taper inwardly and upwardly from said bottom surface at equal angles defining inclined surfaces and terminating at the said top surface, and first and second end edges defining the length of the said support member, opposed notches being provided in the respective side surfaces inwardly from said first and second end edges and equidistant therefrom, each said notch being defined by vertically disposed, spaced-apart shoulders extending inwardly from respective side surfaces and perpendicular thereto and terminating at and defining planar beveled surfaces in parallel disposition to respective non-parallel side surfaces;

(b). an elongated cross-bar having a rectangular-shaped cross section and being defined by horizontally disposed, planar, parallel top and bottom surfaces, vertically disposed, planar, parallel sides of somewhat greater width dimension than the width dimension of said top and bottom surfaces, and first and second ends determining the length of said cross-bar, the said elongated support member and the cross-bar being of the same length, vertically disposed grooves being provided in the said sides of the cross-bar in opposition to one another and inwardly from the said first and second ends thereof equidistantly, each said groove being of rectangular-shape and being defined by vertically disposed, spaced-apart, parallel shoulders extending inwardly from respective sides and terminating in vertically disposed, planar surfaces which surfaces in opposition to one another define vertically disposed webs;

(c). first and second brace members each having a trapezoidal shape and being defined by a rectangular-shaped cross section defined by a planar, horizontally disposed top edge and a planar, horizontally disposed bottom edge parallel thereto and of somewhat greater length than said top edge, planar, vertically disposed, parallel front and back surfaces, and planar, vertically disposed side edges which incline inwardly toward one another at equal angles and connect said top edge to said bottom edge, a notch being provided in each said brace member of rectangular shape and extending vertically downwardly from the said top edge a predetermined distance sufficient to accommodate the vertical dimension of the said cross-bar so that the plane defined by the said top edge includes that defined by the top surface of the cross-bar, said notch being defined by vertically disposed, planar, spaced-apart shoulders extending inwardly from the said top edge and terminating in a horizontally disposed, planar bottom surface parallel to the said top edge, a web of the cross-bar being located in a notch in each of the said braces in interlocking engagement and providing the top surface of the crossbar in abutting engagement with the bottom surface of the top supporting member, and along its entire length, said brace members each being further defined by rectangular-shaped grooves provided in the said front and back surfaces in opposition to one another inwardly from respective side edges the same distance and extending from the said top edge to the said bottom edge of each said brace member, each said groove being defined by spaced-apart, parallel shoulders extending inwardly a predetermined distance from respective front and back surfaces and terminating in planar surfaces parallel to the front and back surfaces and defining webs extending from the top edge to the bottom edge of the brace member in parallel disposition to respective side edges; and (d). four elongated, rectangular-shaped leg members each of which is defined by inner and outer parallel, planar surfaces, parallel, planar side surfaces intersecting therewith, and top and bottom planar, parallel edges, the planes of said top and bottom edges being parallel to one another and intersecting with the planes defined by the inner and outer surfaces so as to provide a beveled surface, an elongated rectangular-shaped slot being provided in each said leg member and extending longitudinally inwardly from the top edge thereof the same predetermined distance, each said slot being located midway between the side edges and being defined by spaced-apart, parallel, vertically disposed planar sides which terminate in bottom end surfaces parallel to and lying in a plane parallel to that defined by the top edge of the leg member, the opposing webs in a brace member being located in the said elongated slots of opposing leg members whereby to provide the opposing leg members and brace member in interlocking engagement with one another.

8. Kit according to claim 7 wherein the elongated top support member, the cross-bar, brace members, and leg members are of wood of conventional dimensions.

9. Kit according to claim 8 wherein the elongated top support member is cut from a 1"×6", the cross-bar and leg members are cut from 1"×4", and the brace members are cut from 1"×8" lumber.

10. Kit according to claim 7 wherein the elongated top support member, cross-bar, brace member, and leg members are of plastic.

* * * * *

UNITED STATES PATENT AND TRADEMARK OFFICE

CERTIFICATE OF CORRECTION

PATENT NO. : 4,890,693
DATED : January 2, 1990
INVENTOR(S) : Charles E. O'Brien

It is certified that error appears in the above-identified patent and that said Letters Patent is hereby corrected as shown below:

Column 2, line 1, the colon (:) following the word "shape" should be deleted.

Column 6, line 8, the word "final" which appears between the words "longitudinal" and "length" should be deleted.

Claim 5, column 10, line 33, the phrase -defined by spaced-apart, parallel shoulders extending- should be inserted before the word "inwardly."

Signed and Sealed this

First Day of January, 1991

*Attest:*

HARRY F. MANBECK, JR.

*Attesting Officer*

*Commissioner of Patents and Trademarks*